US008803021B2

(12) United States Patent
Noisette et al.

(10) Patent No.: US 8,803,021 B2
(45) Date of Patent: Aug. 12, 2014

(54) SWITCH UNIT, METHOD FOR ASSEMBLING A SWITCH UNIT, AND CIRCUIT BREAKER FOR A MEDIUM VOLTAGE CIRCUIT

(71) Applicant: ABB Technology AG, Zürich (CH)

(72) Inventors: Philippe Noisette, Sergy (FR); Yoann Alphand, Fegersheim (FR); Philippe Häberlin, Troinex (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/651,832

(22) Filed: Oct. 15, 2012

(65) Prior Publication Data

US 2013/0037520 A1 Feb. 14, 2013

Related U.S. Application Data

(63) Continuation of application No. PCT/EP2011/055975, filed on Apr. 15, 2011.

(30) Foreign Application Priority Data

Apr. 16, 2010 (EP) ..... 10160111

(51) Int. Cl.
*H01H 9/36* (2006.01)
*H01H 33/10* (2006.01)

(52) U.S. Cl.
USPC ..... 218/149; 218/15; 335/201

(58) Field of Classification Search
CPC ..... H01H 33/76; H01H 33/10; H01H 9/30; H01H 9/36; H01H 9/34
USPC ..... 218/148–157, 15, 34–42
See application file for complete search history.

(56) References Cited

U.S. PATENT DOCUMENTS

| | | | | |
|---|---|---|---|---|
| 2,160,681 | A | 5/1939 | Sandin | |
| 2,236,580 | A | 4/1941 | Sandin et al. | |
| 4,866,226 | A * | 9/1989 | Hisatsune et al. | 218/37 |
| 6,194,984 | B1 * | 2/2001 | Kappel et al. | 218/152 |
| 2009/0266794 | A1 * | 10/2009 | Heydendorf et al. | 218/149 |

FOREIGN PATENT DOCUMENTS

| | | | |
|---|---|---|---|
| DE | 32 47 681 | A1 | 6/1984 |
| EP | 0 299 460 | A2 | 1/1989 |
| WO | WO 94/11894 | A1 | 5/1994 |

OTHER PUBLICATIONS

International Search Report (PCT/ISA/210) issued on Jul. 11, 2011, by the European Patent Office as the International Searching Authority for International Application No. PCT/EP2011/055975.

(Continued)

*Primary Examiner* — Amy Cohen Johnson
*Assistant Examiner* — Marina Fishman
(74) *Attorney, Agent, or Firm* — Buchanan Ingersoll & Rooney

(57) ABSTRACT

A switch unit for a DC circuit is disclosed, which includes a first switch contact, and a second switch contact, which is movable between a first position, wherein the first switch contact contacts the second switch contact, and a second position, wherein the second switch contact is separated from the first switch contact. A positioning element to position an arc chute on the switch unit, the arc chute comprises a plurality of substantially parallel metal plates, the positioning element arranged to guide an arc, which is created between the first switch contact and the second switch contact, into the arc chute in an arc displacement direction in order to be extinguished. At least one gas emitting element, wherein at an interruption operation of the circuit breaker at its nominal current, the arc between the first switch contact and the second switch contact vaporizes a portion of the gas emitting layer.

19 Claims, 7 Drawing Sheets

(56) References Cited

OTHER PUBLICATIONS

Written Opinion (PCT/ISA/237) issued on Jul. 11, 2011, by the European Patent Office as the International Searching Authority for International Application No. PCT/EP2011/055975.

European Search Report for EP 10160111.0 dated Sep. 21, 2010.

Notification Concerning Transmittal of International Preliminary Report on Patentability (Forms PCT/IB/326 and PCT/IB/373) and the Written Opinion of the International Searching Authority (Form PCT/ISA/237) dated Oct. 26, 2012, issued in corresponding International Application No. PCT/EP2011/055975. (6 pages).

* cited by examiner

SWITCH UNIT, METHOD FOR ASSEMBLING A SWITCH UNIT, AND CIRCUIT BREAKER FOR A MEDIUM VOLTAGE CIRCUIT

RELATED APPLICATION(S)

This application claims priority as a continuation application under 35 U.S.C. §120 to PCT/EP2011/055975, which was filed as an International Application on Apr. 15, 2011, designating the U.S., and which claims priority to European Application 10160111.0 filed on Apr. 16, 2010. The entire contents of these applications are hereby incorporated by reference in their entireties.

FIELD

The present disclosure relates to a switch unit for a medium voltage circuit breaker.

BACKGROUND

Circuit breakers or air circuit breakers are used in a DC circuit on railway vehicles. Other examples may be tramways or trolley buses. For example, such high speed DC circuit breakers may switch direct nominal currents with more than 5000 Ampere and at a voltage level of more than 900 Volt.

For example, when disconnecting a first switch contact from a second switch contact, gases between the switch contacts can quickly become conductive because of air ionisation and a plasma may appear. Further, a back re-ignition phenomena can occur at relatively high currents, for example, for currents greater than 15 kA. Thus, the circuit breaker capability can be decreased. Further, at certain current levels, the arc between the first contact and the second switch contact may not climb inside the arc chute.

In arc chute assemblies of DC-circuit breakers, plastic frames and metal plates are alternating stacked upon each other, wherein the metal plates are disposed on the plastic frames. The plastic frames form dielectric layers between the metal plates. The plastic frames have a cut out such that an arc may be built up between two adjacent metal plates. The plastic frames can be used to generate gas, such that the heat in the arc can be quickly blown out of the arc chute and to increase the arc voltage by a change of the chemical composition of the air between the metal plates.

The arc can move on the metal plates, and can be within the cut out. However, the arc can stay at a corner of the cut out. Thus, the metal of the metal plates can get very hot at these corners and may start melting. For example, adjacent metal plates can be connected to each other by melted metal.

This leads to a short lifetime of the arc chutes and a big structural dimension due to an increased distance between the metal plates to avoid a connection between two adjacent metal plates due to melted metal, and the increased number of the metal plates and plastic frames.

Known arc chutes can be heavy and have a high height. Further, the wear can be important at high currents, for example, at currents greater than 1 kA. The wear depends on the number of operations, the current density and the arcing time (time constant). Thus, the wear of the arc chute is not predictable. Hence, maintenance operations are difficult to plan but are nevertheless indispensable. For example, the metal or steel plates may be often checked and replaced. Further, the plastic frames may be checked as well and sometimes even replaced. In addition, there is a risk of steel drop minimum between the plates, such that less voltage is built up. For example, the circuit breaker may not be able to cut the circuit the next time. Further, more than 120 components may have to be assembled and the clearance distance is increased.

In EP0299460A2, a circuit breaker with a single arc chute stack having substantially parallel and U-shaped metal plates is disclosed. Two insulating plates are aligned in vertical direction of the stack and positioned inside of the two leg portions formed by the U-shaped metal plates in order to assist the arc extinction. The switching contacts of the breaker are arranged in between the two insulating plates.

WO 94/11894A1 discloses a single pole breaker unit with 30 Ampere nominal current rating, having an operating handle and a single stack of arc chute plates for extinction of the electric arc. To assist the arc extinction the arc chute is made of a thermoplastic cradle member with slots in which the arc chute plates inserted and which cradle member emits gas upon attack by the arc.

DE3247681A1 discloses a miniature circuit breaker having a single arc chute stack of a plurality of metal sheets. The arc extinction is assisted by a layer surface of a gas emitting material coated on each of the metal sheets. At least one switching contact is connected to an arc horn. The moving direction of the switching contacts is perpendicular to the gas emitting layer surface.

In U.S. Pat. No. 2,236,580, a circuit breaker with a hand operating lever is disclosed having a single arc chute stack of a plurality of metal plates arranged in non-parallel manner to each other. To assist the arc extinction, the side wall members of the arc chute are coated with boric acid.

SUMMARY

A switch unit for a DC circuit is disclosed comprising: a first switch contact; a second switch contact, which is movable between a first position, wherein the first switch contact contacts the second switch contact, and a second position, wherein the second switch contact is separated from the first switch contact; a positioning element to position an arc chute on the switch unit, wherein the arc chute comprises a plurality of substantially parallel metal plates, the positioning element being arranged to guide an arc, when created between the first switch contact and the second switch contact, into the arc chute in an arc displacement direction in order to be extinguished; at least one gas emitting element comprising a gas emitting layer having a layer surface facing the first switch contact and the second switch contact, wherein the gas emitting element is arranged at a distance to the first switch contact and the second switch contact, and wherein upon an interruption operation of the circuit breaker at its nominal current, the arc between the first switch contact and the second switch contact will vaporize a portion of the gas emitting layer; a first horn electrically connected to the first switch contact for guiding a first foot of the arc to a first stack of the arc chute; and a second horn electrically connected to the second switch contact for guiding a second foot of the arc to a second stack of the arc chute, wherein the layer surface of the at least one gas emitting element is parallel to at least a portion of the first horn and the second horn in a movable direction of the second switch contact.

A circuit breaker for a medium voltage circuit is disclosed comprising: a switch unit, comprising: a first switch contact; a second switch contact, which is movable between a first position, wherein the first switch contact contacts the second switch contact, and a second position, wherein the second switch contact is separated from the first switch contact; a positioning element to position an arc chute on the switch unit, wherein the arc chute comprises a plurality of substantially parallel metal plates, the positioning element being arranged to guide an arc, which is created between the first switch contact and the second switch contact, into the arc chute in an arc displacement direction in order to be extinguished; at least one gas emitting element comprising a gas emitting layer having a layer surface facing the first switch contact and the second switch contact, wherein the gas emitting element is arranged at a distance to the first switch contact and the second switch contact, and wherein upon an interruption operation of the circuit breaker at its nominal current, the arc between the first switch contact and the second switch contact will vaporize a portion of the gas emitting layer; a first horn electrically connected to the first switch contact for guiding a first foot of the arc to a first stack of the arc chute; and a second horn electrically connected to the second switch contact for guiding a second foot of the arc to a second stack of the arc chute, wherein the layer surface of the at least one gas emitting element is parallel to at least a portion of the first horn and the second horn in a moveable direction of the second switch contact; and an arc chute having at least one stack of parallel metal plates, and wherein more than 70% of a surface of a metal plate of the at least one stack faces a surface of an adjacent metal plate.

A method for assembling a DC circuit breaker is disclosed, comprising: providing a switch unit including a first switch contact, and a second switch contact movable between first position, wherein the first switch contact contacts the second switch contact and a second position, and the second switch contact is separated from the first switch contact; disposing at least one gas emitting element having a gas emitting layer having a layer surface facing to the first switch contact and the second switch contact in the switch unit, wherein the at least one layer surface is disposed at a distance to the first switch contact and the second switch contact, and wherein upon an interruption operation of the circuit breaker at its rated current, an arc between the first switch contact and the second switch contact vaporizes a portion of the gas emitting layer; connecting an arc chute having a plurality of substantially parallel metal plates to the switch unit, wherein the arc created between the first switch contact and the second switch contact is guided into the arc chute; arranging a first horn electrically connected to the first switch contact to guide a first foot of the arc to the first switch contact; arranging a second horn electrically connected to the second switch contact to guide a second foot of the arc to the second switch contact, and arranging the layer surface of the at least one gas emitting element to be parallel to at least a portion of the first horn and the second horn in a moveable direction of the second switch contact, and wherein the portion of the first horn and/or the second horn disposed in parallel to the layer surface of the at least one gas emitting element is greater than 25% of the first and/or second horn, and greater than about 50% of an extension of the first and/or second horn in the moving direction of the second switch contact.

BRIEF DESCRIPTION OF THE DRAWINGS

The disclosure will be explained hereinafter on the basis of the exemplary embodiments illustrated in the drawings, in which.

DETAILED DESCRIPTION

Figure 1:
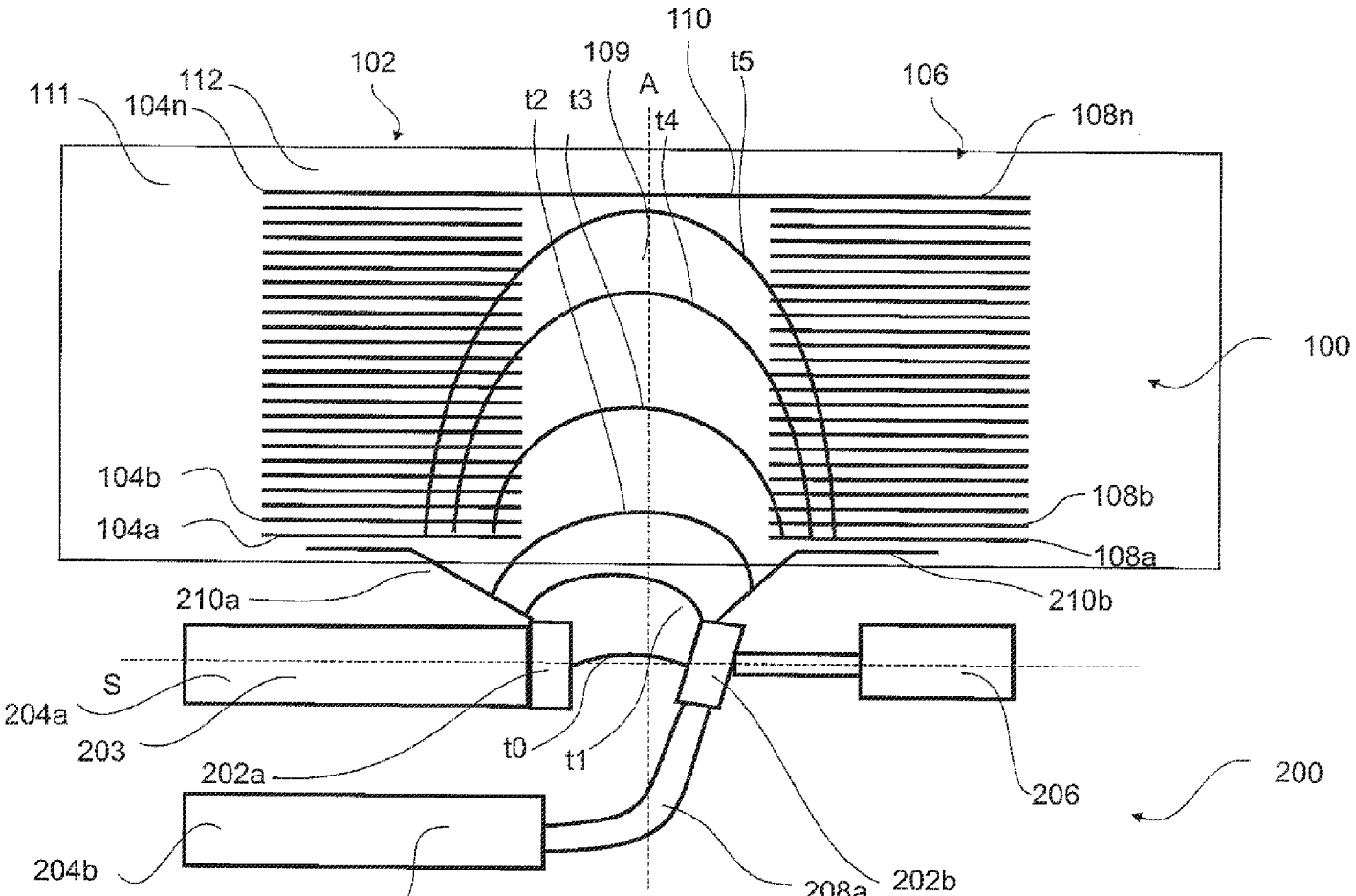
FIG. 1 shows schematically a side view of an exemplary embodiment of a circuit breaker with open switch contacts.

The present disclosure relates to a switch unit for a medium voltage circuit breaker including a first switch contact and a second switch contact movable between a first position, wherein the first switch contact contacts the second switch contact, and a second position, wherein the second switch contact is separated from the first switch contact.

Further, the present disclosure relates to a circuit breaker for a medium voltage working at a voltage range between 400V and 3.600V.

In accordance with an exemplary embodiment, a switch unit for a traction vehicle DC circuit breaker, a substation DC circuit breaker and a method for assembling a switch unit, which has an increased breaking capability and is easier to maintain are disclosed.

According to an exemplary embodiment, a switch unit for a direct current (DC) medium voltage circuit breaker is disclosed, includes: a first switch contact; a second switch contact movable between first position, wherein the first switch contact contacts the second switch contact, and a second position, wherein the second switch contact is separated from the first switch contact; a positioning device to position an arc chute on the switch unit, wherein the arc chute includes a plurality of substantially parallel metal plates, the positioning element being arranged such that an arc, which is created between the first switch contact and the second switch contact is guided into the arc chute in an arc displacement direction in order to be extinguished; and at least one gas emitting element including a gas emitting layer having a layer surface facing the first switch contact and the second switch contact, wherein the gas emitting element is arranged at a distance to the first switch contact and the second switch contact, wherein at an interruption operation of the circuit breaker at its nominal current an arc between the first switch contact and the second switch contact vaporizes a portion of the gas emitting layer.

In an exemplary embodiment, the circuit breaker can be an air DC circuit breaker. Thus, each current interruption generates an arc. For example, an arc starts from a contact separation and remains until the current is zero. In an exemplary embodiment, to be able to cut out DC currents high speed DC circuit breakers build up DC voltages that are higher than the net voltage. To build up a DC voltage, air circuit breakers may use an arc chute or extinguish chamber in which metallic plates are used to split arcs into several partial arcs, the arc is lengthened and gases are used to increase the arc voltage by a chemical effect, for example by evaporation of plastic or another material.

With a gas emitting plate, back arc re-ignition can be delayed. For example, the overpressure helps to push the arc into the arc chute. Thus, the breaker capability is increased.

In an exemplary embodiment, the circuit breaker may switch direct currents with more than 600 Ampere and at voltage level of more than 500 Volt.

In an exemplary embodiment, the arc created between the first switch contact and the second switch contact creates so much heat, such that the portion of the gas emitting layer is vaporized.

In an exemplary embodiment, the gas emitting layer is formed by a material that increases, in a vaporized state the air resistance between the first switch contact and the second switch contact.

In an exemplary embodiment, the positioning device is a screw, a hinge, a bolt, a stop, a bar, and the like. For example, the positioning device is used to connect the arc chute to the switching unit.

For example, in an exemplary embodiment, the second switch contact is movable substantially along a moving direction, wherein the layer surface is arranged substantially parallel to the plane defined by the moving direction and the arc displacement direction.

In an exemplary embodiment, which may be combined with other embodiments disclosed herein, the at least one gas emitting element is disposed such that the vaporized gas emitting layer pushes the arc into the arc chute and/or increases the air resistance between the first switch contact and the second switch contact.

For example, in an exemplary embodiment, the switch unit includes at least two gas emitting elements having a layer surface facing the first switch contact and the second switch contact, wherein layer surfaces of the at least two plates are facing each other.

In an exemplary embodiment, the layer surfaces of the at least two plates are disposed substantially in parallel.

In an exemplary embodiment, which may be combined with other embodiments disclosed herein, the distance of the layer surfaces to the first switch contact and/or the second switch contact, for example, in the first position and the second position of the second switch contact, is between about 15 mm and about 40 mm, for example between about 25 mm and about 30 mm.

For example, in an embodiment, the gas emitting layer is manufactured from Polytetrafluoroethylene (PTFE), wherein for example the gas emitting layer has a thickness of about 2 mm to about 8 mm, for example of about 3 mm to about 5 mm. In another exemplary embodiment the gas emitting layer is manufactured from other types of a Fluoropolymers, for example, form Fluorinated ethylene-propylene (FEP), Perfluoroalkoxy (PFA), Polychlorotrifluoroethylene (PCTFE), Polyvinylidene fluoride (PVDF) or Polyvinylidene fluoride (PVF). In another exemplary embodiment the gas emitting layer is manufactured from types of Fluoroelastomers as Copolymers or Terpolymers. In another exemplary embodiment the gas emitting elements are not massive pieces of material rather have a surface coating of a type of Fluoropolymers, for example, PTFE, or of a type of Fluoroelastomers, for example, a Copolymer which evaporate the gas.

In an exemplary embodiment, which may be combined with other embodiments disclosed herein, the switch unit may further include a first horn electrically connected to the first switch contact, wherein the first horn is disposed to guide a first foot of an electric arc to the arc chute, for example, to a first stack of the arc chute, and/or a second horn electrically connected to the second switch contact, wherein the second horn is disposed to guide a second foot of the electric arc to the arc chute, for example, to a second stack of the arc chute, wherein the layer surface has a size such that at least a portion of the first horn and/or the second horn in the direction of a moving direction of the second switch contact is disposed in parallel to the layer surface, wherein for example, the portion is greater than 25% of the horn, for example greater than about 50% of the extension of the horn in the direction of the moving direction.

For example, in an embodiment, the at least one gas emitting element is plate shaped, and, for example, a substantially T-shaped plate, having a base portion and two arms, wherein the switch unit includes a switching space, in which the first switch contact and the second switch contact in the first position and in the second position are permanently disposed, wherein the base portion of the at least one gas emitting element is disposed in the switching space, and for example the arms extend in parallel to the first and/or second horn.

In an exemplary embodiment, which may be combined with other embodiments disclosed herein, the at least one gas emitting layer extends in arc displacement direction substantially to the plane of the closest metal plate for splitting the arc in the arc chute. The closest metal plate can be the most proximal metal plate of the arc chute towards the switch unit.

According to a further exemplary embodiment, a circuit breaker for a medium voltage circuit is provided including: a switch unit according to one the embodiment disclosed herein; and an arc chute, the arc chute includes at least one stack of substantially parallel metal plates, wherein more than 70%, for example more than 90%, of a surface of a metal plate of the stack face the surface of an adjacent metal plate, for example in the same stack.

In an exemplary embodiment, which may be combined with other embodiments disclosed herein, the metal plates of the arc chute have a surface of about 3000 $mm^2$ to about 12000 $mm^2$, for example between about 5000 $mm^2$ and about 8000 $mm^2$ and/or have an ratio between extension in the longitudinal direction, parallel to the second axis, and the extension in a transversal direction of about 1 to 2, for example 1:1 to 1:5.

For example, in an exemplary embodiment, the circuit breaker is an air circuit breaker.

In an exemplary embodiment, which may be combined with other embodiments disclosed herein, the circuit breaker is a circuit breaker for a traction vehicle, for example a railway vehicle, a tramway, a trolleybus and a substation providing energy for rolling stocks or the like.

In an exemplary embodiment, which may be combined with other embodiments disclosed herein, the arc chute includes at least one stack of a plurality of substantially parallel metal plates, the at least one stack defining a first axis in parallel to a stacking direction; an arc space adapted to allow an arc to extend along the first axis, wherein a second axis traversing in parallel to the metal plates the at least one stack and the arc space substantially orthogonal to the first axis; and an arc-chute housing having at least one side wall, the at least one side wall being substantially parallel to the second axis, wherein the distance between the at least one sidewall and the metal plates is less than 5 mm, for example less than 2 mm.

A circuit breaker using such an arc chute according to an exemplary embodiment can consume less space. For example, the circuit breaker can be used on trains where the space is limited.

In an exemplary embodiment, which may be combined with other embodiments disclosed herein, the at least one side wall contacts the metal plates.

For example, in an embodiment, the arc chute housing has two side walls.

In an exemplary embodiment, the at least one side wall has a dimension in direction of the second axis, such that the side wall covers completely at least the at least one stack and the arc space. For example in case of two stacks, the side wall covers the two stacks and the arc space between the two stacks. In an exemplary embodiment, the at least one side wall has a dimension in direction of the second axis corresponding at least 110%, for example at least 120% of the dimension of the at least one stack, for example of the two stacks, and the arc space in direction of the second direction.

In accordance with an exemplary embodiment, the side wall has a height in direction of the stacking direction corresponding at least to the dimension of the stack in direction of the first axis.

In an exemplary embodiment, which may be combined with other embodiments disclosed herein, the side wall is substantially closed.

In an exemplary embodiment, which may be combined with other embodiments disclosed herein, at least two parallel stacks of metal plates, wherein a second axis traverses the at least two stacks.

For example, in an embodiment, the metal plates are substantially rectangular and have for example respectively a substantially V-shaped cut-out directed to the arc space, wherein the second axis is substantially parallel to two side edges of the metal plates adjacent to the sidewalls.

In an exemplary embodiment, which may be combined with other embodiments disclosed herein, the housing of the arc chute has openings in direction of the second axis.

In an exemplary embodiment, which may be combined with other embodiments disclosed herein, the opening has dimension in direction of the first axis of at least 90%, for example 95%, of the at least one stack.

In an exemplary embodiment, the opening has a dimension corresponding substantially to the dimension of the metal plates in a direction orthogonal to the first axis and the second axis, at least 90%, for example, at least 95% of the width of the metal plates. The width of the metal plates is measured along a third axis orthogonal to the first axis and orthogonal to the second axis.

In an exemplary embodiment, wherein the metal plates are substantially rectangular, having a first edge in the direction of the arc space, and a second edge opposite to the first edge, and for example two side edges substantially parallel to the second axis, wherein the opening of the arc chute housing is adjacent to and/or on the side of the second edge of the metal plates.

In an exemplary embodiment, the at least one stack includes a group of metal plates, wherein the metal plates of the group of metal plates are supported by at least one support device adapted to maintain the metal plates in a parallel relationship and to insert and remove the group of metal plates together.

In an exemplary embodiment, which may be combined with other embodiments disclosed herein, each metal plate of the group of metal plates includes a plurality of cut-outs for inserting the support device, wherein for example the metal plates and the support device are adapted to each other, such that when the support device is inserted in the respective cut-outs of the metal plates a rearward edge of the support device opposite to the metal plate lies substantially at the or a greater distance to the sidewall than the metal plate, for example the side edge parallel to the second axis of the metal plate, into which the support device is inserted.

For example, the metal plates of the group of metal plates can have respectively a distance between each other of about 2 mm to about 4 mm.

According to another exemplary embodiment, a method for assembling a DC circuit breaker is provided, including providing a switch unit including a first switch contact; and a second switch contact movable between first position, wherein the first switch contact contacts the second switch contact and a second position, wherein the second switch contact is separated from the first switch contact; and disposing at least one gas emitting element including a gas emitting layer having a layer surface facing to the first switch contact and the second switch contact in the switch unit, wherein the at least one layer surface is disposed at a distance to the first switch contact and the second switch contact, such that at an interruption operation of the circuit breaker at its rated current an arc between the first switch contact and the second switch contact vaporizes a portion of the gas emitting layer; and connecting an arc chute having a plurality of substantially parallel metal plates to the switch unit, such that an arc created between the first switch contact and the second switch contact is guided into the arc chute.

Reference will now be made in detail to the various embodiments, one or more examples of which are illustrated in the figures. Each example is provided by way of explanation, and is not meant as a limitation of the invention. Within the following description of the drawings, the same reference numbers refer to the same components. For example, only the differences with respect to individual embodiments are described.

FIG. 1 shows a side view of a medium voltage direct current (DC) circuit breaker. The circuit breaker can be an air circuit breaker working at medium voltages, for example, between 400V and 3600V. The circuit breaker includes an arc chute 100 and a switch unit 200. The arc chute includes a first stack 102 of metal plates 104*a*, 104*b*, . . . , 104*n* and in an embodiment, which may be combined with other embodiments disclosed herein a second stack 106 of metal plates 108*a*, 108*b*, . . . , 108*n*.

In an exemplary embodiment, the metal plates 104*a*, 104*b*, . . . , 104*n*, 108*a*, 108*b*, . . . , 108*n* of the first and the second stack 102, 106 are substantially equal. An arc space 109 is disposed between the first stack 102 and the second stack 106 of metal plates. For example, when the circuit breaker is opened, an arc mounts in the arc space 109.

The arc chute is symmetric to an axis traversing the arc space 109 which is parallel to the stacking direction of first stack 102 of metal plates and the second stack 106 of metal plates. Further, in an exemplary embodiment, the top level metal plate 104*n* of the first stack 102 is electrically connected to the top level metal plate 108*n* of the second stack 106 with a connection bar 110. Thus, the top level metal plate 104*n* of the first stack is on the same electrical potential as the top level metal plate 108*n* of the second stack 106.

The lowest metal plate or level zero metal plate 104*a* of the first stack 102 and the lowest metal plate or level zero metal plate 108*a* can be the closest metal plates of the respective stacks 102, 106 with respect to the switch unit 200. Hence, the lowest metal plates 104*a*, 108*a* and the top level plates 104*n*, 108*n* are disposed on opposite ends in stacking direction of the respective stack 102, 106 of metal plates.

In an exemplary embodiment, each stack 102, 106 includes about 36 metal plates 104*a*, 104*b*, . . . 104*n*, 108*a*, 108*b*, . . . 108*n*. Other embodiments may event include more than 36 metal plates. The number of metal plates can depend on the arcing voltage respectively on the nominal current that is switched by the circuit breaker.

In an exemplary embodiment, the arc chute 100 is disposed in a casing having at least one side wall 112. In an exemplary embodiment, the arc chute 100 with its casing may be relatively easily separated from the switch unit 200. Thus, the maintenance time may be reduced.

The switch unit 200 includes a first switch contact 202*a*, which may be electrically connected to an electric network or a load by a first switch contact terminal 204*a*. The first switch contact can be connected with a first switch contact bar or bus bar 203 to the first switch contact terminal 204*a*, wherein the first switch contact bar 203 includes the first switch contact terminal 204*a*. The first switch contact 202*a* can be fixed to a first end of the first switch contact bar 203, and the first switch contact terminal 204 is disposed at a second end of the first switch contact bar 203, opposite to the first end.

Further, the switch unit 200 includes a second switch contact 202*b*. The second switch unit is moved by a driving unit 206 in a moving direction S, to move the second switch contact 202*b* from a first position in which the first switch contact 202*a* is in physical contact with the second switch contact 202*b*, and a second position in which the first switch contact 202*a* is separated from the second switch contact 202*b*. The second position is shown in FIG. 1. The second switch contact 202*b* may be connected via a second switch contact terminal 204*b* to an electrical network or the load. The second switch contact 202*b* can be electrically connected to the second switch contact terminal 204*b* by a flexible conductor 208*a* and a second switch contact bar 208*b*, wherein the flexible conductor 208*a* is connected to a first end of the second switch contact bar 208*b*. The second switch contact terminal 204*b* can be disposed at a second end of the second switch contact bar 208*b*, wherein the second end is opposite to the first end of the second switch contact bar 208*b*.

The arc space 109 can be disposed above the first and second switch contact in operation of the circuit breaker, when the circuit breaker is in closed position, for example, the first switch contact 202*a* contacts the second switch contact 202*b*. Further, the stacking direction of the stack of metal plates 102, 106 is substantially parallel to an arc displacement direction A, which is substantially orthogonal to the moving direction. The stacking direction or arc displacement direction A corresponds to a direction in which the arc extends into the arc chute. The metal plates 104*a*, 104*b*, . . . , 104*n*, 108*a*, 108*b*, . . . , 108*n* and the connection bar 110 can be substantially parallel to the moving direction S.

A first horn 210*a* is fixed to the first contact 202*a* to guide a foot of an arc to the metal plates 104*a*, 104*b*, . . . 104*n*, for example, to the lowest metal plate 104*a*, of the first stack 102 of the arc chute 100. Further, the switch unit 200 is provided with the second horn 210*b* which is disposed, such that the arc having foot at the second switch contact 202*b* jumps to the horn 210*b* and moves to the metal plates 108*a*, 108*b*, . . . , 108*n*, for example, to the lowest metal plate 108*a*, of the second stack 106.

In an exemplary embodiment, the lowest metal plate 104*a* of the first stack 102 and the lowest metal plate 108*a* of the second stack 106 are respectively electrically connected to the first switch contact 202*a* and the second switch contact 202*b*. Thus, an arc foot of an arc created by interrupting a current may not remain on the first and second horns 210*a*, 210*b* and jumps onto the lowest metal plates 104*a*, 108*a*. Once, the respective arc foot has jumped to the lowest metal plates, current flows through a respective equipotential connection. The horns may not heat up by the arcs and thus do not evaporate. Further, the horn wear out is reduced such that the horns, for example, the first horn 210*a*, and a second horn 210*b* may withstand the life time of the circuit breaker. The heat dissipation can be increased once the arc has jumped onto the lowest metal plates. Further, less gas is generated close to the switch contacts. A heat concentration close to the switch contacts can be reduced, such that the risk of a plasma generation and recognition phenomenal is reduced.

FIG. 1 shows a side view of the circuit breaker in the open state, wherein the first switch contact 202*a* is separated from the second switch contact 202*b*. Further FIG. 1 shows schematically an arc expansion within the arc chute 200, for example, the arcs at different moments after the opening of the switch by moving the second switch contact 202*b* away from the first switch contact 202*a*.

At a first time, t0, after the contact separation of the first switch contact 202*a* and the second switch contact 202*b* the arcing starts.

Then, at t1, the arc, or one foot of the arc, leaves one of the first or second switch contacts 202*a*, 202*b*, and jumps to the horn 210*a*, 210*b* of the respective switch contact 202*a*, 202*b*. This may either happen first on the fixed, for example, the first switch contact 202*a*, or on the moving contact, for example, the second switch contact 202*b*. At t2, the arc leaves the second switch contact. Then, the arc feet are located on first horn 210*a* and the second horn 210*b*, respectively.

Then, at t3 the arc feet jump on the respective level zero or lowest metal plates 104*a*, 108*a* and the arc continues to climb within the arc chute. At this stage, several little arcs can be generated between respective adjacent metal plates of the first and second stack 102, 104.

At t4 the arc is well established on the lowest metal plates 104*a*, 108*a* of the first and second stack 102, 106, respectively and continues to climb within the arc chute, for example, the arc space 109. Finally, at t5 the arc is fully elongated having reached the top of the arc chute, so that the maximum voltage is built. The voltage built up by the arc starts at t0, increases from t1 to t4, and reaches its maximum value approximately at t5. The sequence is for example influenced by the magnetic field generated by the current, for example, for currents greater than 100 A, a chimney effect due to hot gases, for example, for currents lower than 100 A, and/or the mechanical behaviour of the circuit breaker, for example, the velocity of the second switch contact 202*b*.

In an exemplary embodiment, the arc remains present until the current is zero, then the arc is naturally extinguished. The arcing time is proportional to the prospective short circuit current in time constant of the circuit, the current level when opening, the voltage to be built up for cutting the contact velocity, for example, of the second switch contact, the geometrical circuit breaker design, for example, the chimney effect, and/or the material used which has influence on the gas created in the arc chute or the circuit breaker.

Figure 2:
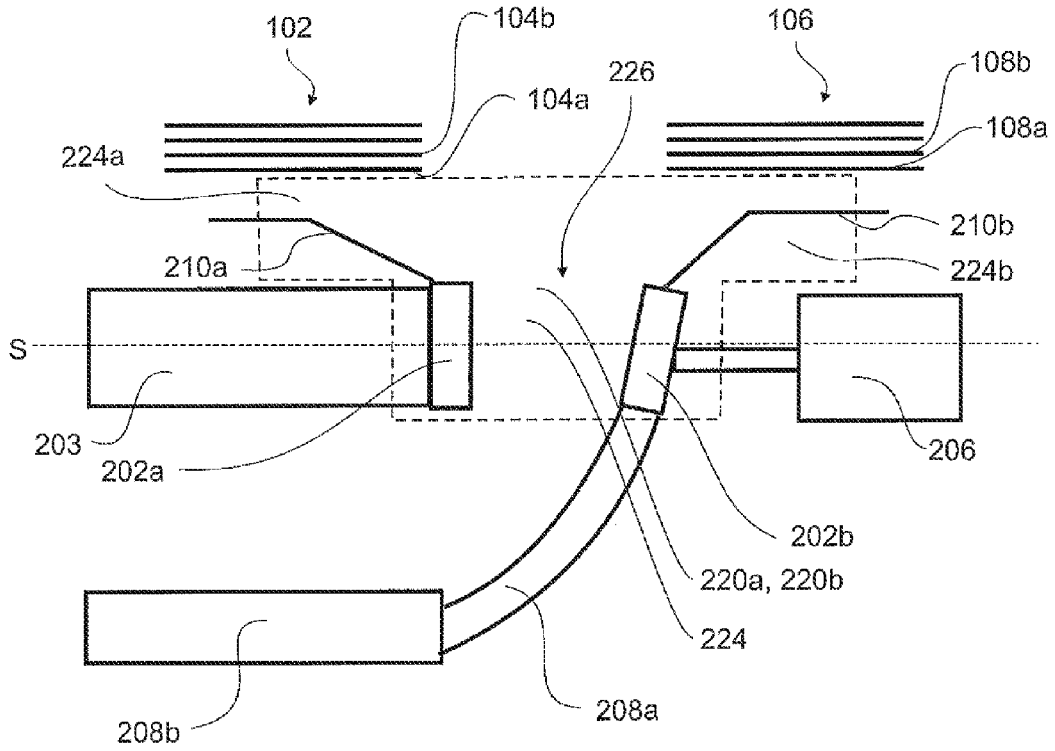
FIG. 2 shows schematically in a side view of a portion of an exemplary switch unit.
Figure 3:
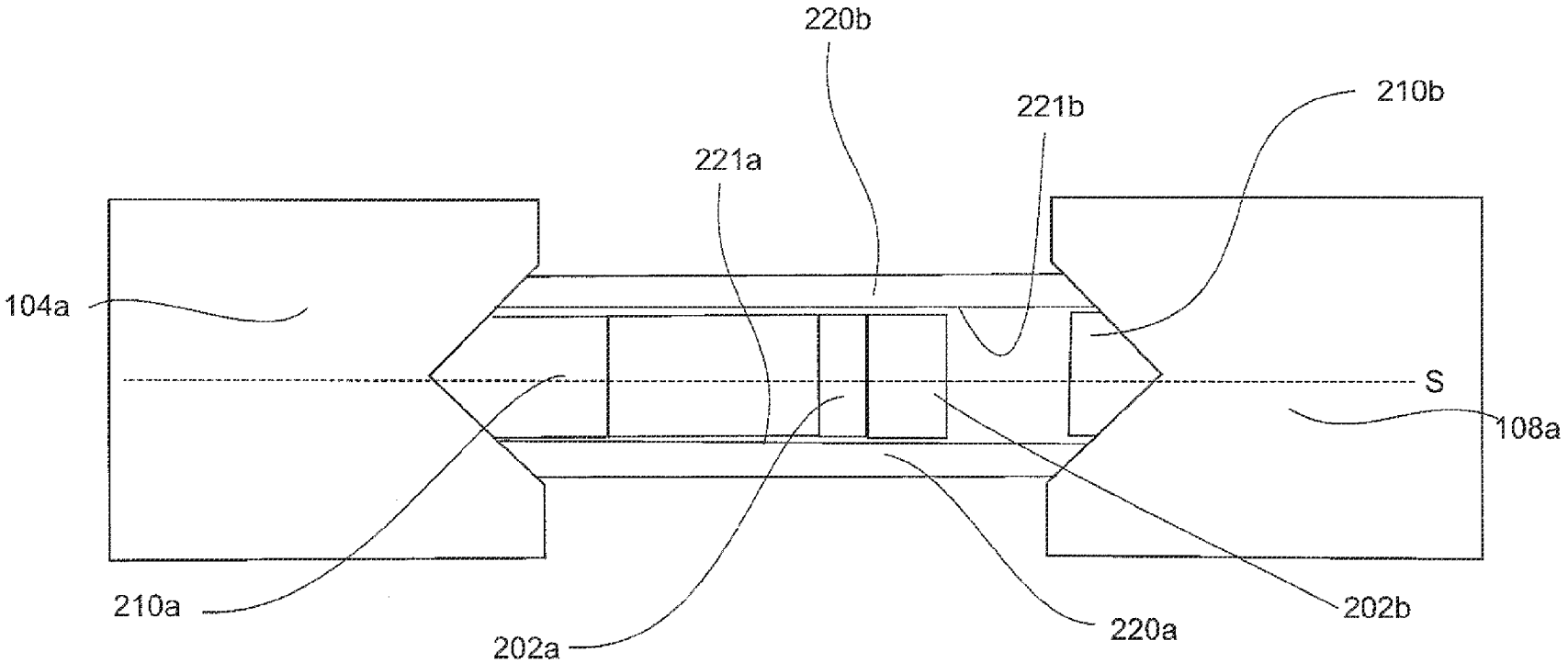
FIG. 3 shows schematically a section of the circuit breaker in a top view.

FIG. 2 shows schematically a perspective view of a portion of the switch unit 200 and FIG. 3 shows a top view of the switch unit 200 and respective lowest metal plates 104*a*, 108*a* of the first stack 102 and a second stack 106 of the arc chute 100. In the switch units 200, a first polytetrafluoroethylene (PTFE) plate 220*a* and a second PTFE plate 220*b* are disposed in parallel to the moving direction or switching axis S of the second switch contact 202*b* and/or in parallel to the stacking direction or arc displacement direction A. Also another material may be used instead or in addition to PTFE, however, the material may generate or evaporate a gas to alter the atmosphere in the circuit breaker to reduce back arc reignition and/or increase the air resistance, for example, in the arc chute and/or the switching space 226 of the switch unit 200.

In an exemplary embodiment, the PTFE plates are substantially T-shaped. However, also plates with another shape may be provided, for example, V-shaped or rectangular shaped PTFE-plates.

In an exemplary embodiment, which may be combined with other embodiments disclosed herein, the first PTFE plate 220*a* and a second PTFE plate 220*b* are disposed, such that a substantial portion in the direction of the moving direction S, for example, at least 25%, of the first horn 210*a* and the second horn 210*b* are respectively disposed between them. In case the PTFE plates 220*a*, 220*b* are T-shaped, they include a base 224 and two arms 224*a*, 224*b*, wherein the arms 224*a*, 224*b* extend from a switching space 226 in which the first switch contact and the second switch contact are permanently disposed in open and closed state of the circuit breaker, for example, when the second switch contact is in the first position and in the second position, between a frame (not shown) of the switch unit 200, supporting the arms 224*a*, 224*b* and thus the PTFE plates 220*a*, 220*b*, and the respective lowest metal plate 104*a*, 108*a* of the first and second stack 102, 106. For example, in case the arc chute is removed from the switch unit 200, the PTFE plates may be easily removed in direction of the arc chute and replaced.

In an exemplary embodiment, which may be combined with other embodiments disclosed herein, the first switch contact 202*a* and/or the second switch contact 202*b* is disposed closely between the two PTFE plates 220*a*, 220*b* in an open state and a closed state of the circuit breaker. The PTFE plates form a limit for the created arcs in switching space 226 in a direction orthogonal to the stacking direction or arc displacement direction A and the switching axis or moving direction S.

In an exemplary embodiment, at least one gas emitting element (220*a*, 220*b*) for example, the PTFE plates, for example, the base 224 and the arms 224*a*, 224*b* of the PTFE plates, extend in the direction of the arc chute substantially to a plane of the lowest metal plates 104*a*, 108*a* of the first stack 102 and a second stack 106, for example, just below the lowest metal plates 104*a*, 108*a*. Thus, during operation, i.e. when the arc chute 100 is mounted on the switch unit 200, the PTFE plates 220*a*, 220*b* do not move in the direction of the stacking direction A. Further, in an embodiment, the PTFE plates 220*a*, 220*b* are arranged, such that they may not move in the direction of the moving direction S.

In case of an opening of the switch contact, when the arc between the first switch contact 202*a* and a second switch contact 202*b* is created, the PTFE plates 220*a*, 220*b* guide the arc between them. For example, due to the hot temperature of the arc, some gas is evaporated from the surface of the PTFE guides, such that the gas pushes the arc out of the region between the first switch contact 202*a* and the second switch contact 202*b*. The arc can be faster guided into the arc chute 100. Further, the gas is used to change the composition of the atmosphere in the arc chute, for example, to increase the resistance between adjacent metal plates 104*a*, 104*b*, . . . , 104*n*, 108*a*, 108*b*, . . . , 108*n*.

With the PTFE plates 220*a*, 220*b* or PTFE gates, back arc re-ignition can be delayed, because the PTFE evaporates very quickly and generates an overpressure. Thus, the overpressure help to push the arc into the arc chute. Further, thanks to the PTFE, chemical gas composition is modified in the region between the first switch contact 202*a*, and the second switch contact 202*b* and the generation of plasma can be delayed. Thus, back arc re-ignition between the contacts may still happen but at much higher currents than without the PTFE plates 220*a*, 220*b*. Thus, the breaker breaking capability is increased.

Figure 4:
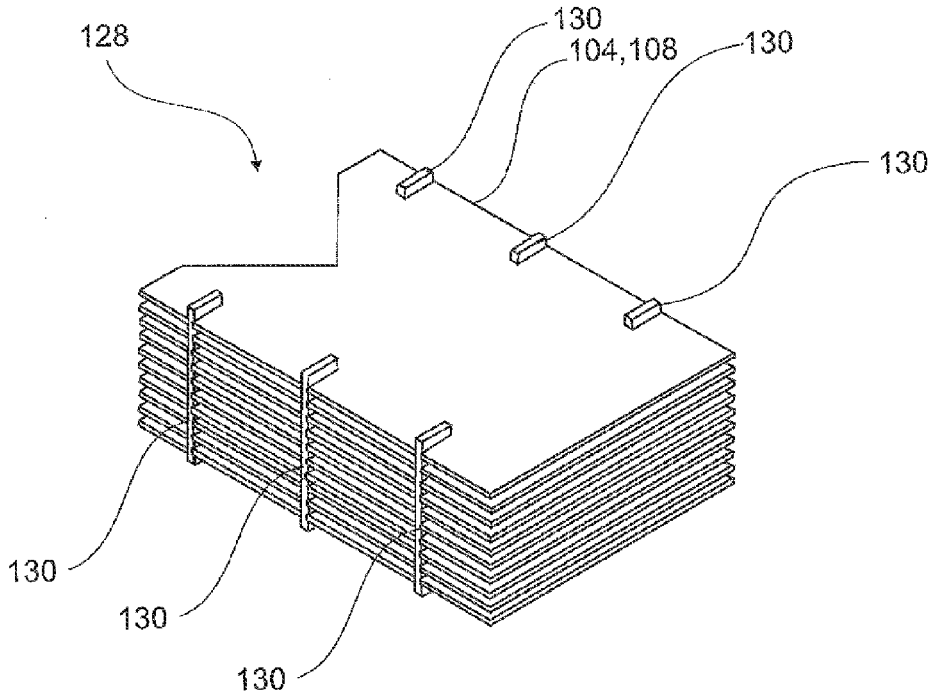
FIG. 4 shows schematically an exemplary group of metal plates.

FIG. 4 shows a group 128 of metal plates 104, 108 for the first stack 102 or for the second stack 106. In an exemplary embodiment, which may be combined with other embodiments disclosed herein, the group of metal plates 128 being connected or grouped by a plurality of comb like support devices 130. For example, the group of metal plates 128 for the arc chute may include five to twenty metal plates, for example, ten metal plates.

Figure 5:
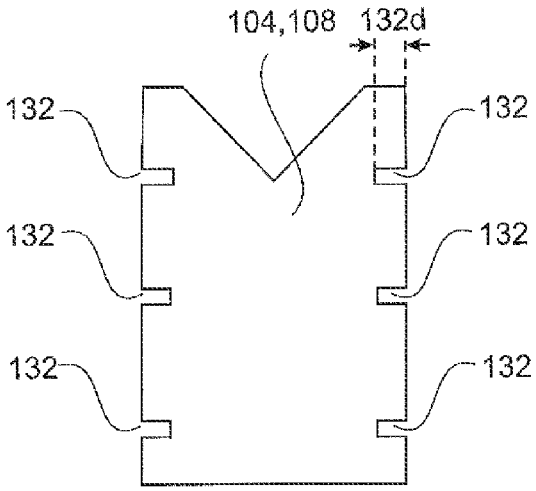
FIG. 5 shows schematically an exemplary metal plate of a stack.

A schematical top view of an exemplary embodiment of a single metal plate 104, 106 is shown in FIG. 5. Each metal plate 104, 106 include a plurality of cut outs 132 for the support device 130, for example, six cut outs as shown in FIG. 5. The cut outs 132 can have a depth 132*d*. Also another number of cut outs may be provided in the metal plates, for example, four cut outs. The cut outs 132 are adapted for the comb like support device 130. In an exemplary embodiment, the cut outs 132 can be substantially rectangular, so that the support device may be slidingly introduced into the cut-outs 132.

The metal plates have a thickness of about 0.5 mm to about 2 mm, for example, between 0.5 and about 1.5 mm, for example, about 1 mm. In an exemplary embodiment, which may be combined with other embodiments disclosed herein, the metal plates 104, 108 may have a surface of about 3000 $mm^2$ to 12000 $mm^2$, for example, between about 5000 $mm^2$ and about 8000 $mm^2$. In an exemplary embodiment, the volume of the metal plates is between about 3000 $mm^3$ and about 20000 $mm^3$, for example, between about 5000 $mm^3$ and about 10000 $mm^3$. For example, a single metal plate or steel plate may have a weight between 30 and 100 g, for example, about 50 g.

In an exemplary embodiment, the metal plates can be substantially rectangular having a V-shaped cut-out at one of the four edges, for example, to be disposed adjacent to the arc space 109. The cut out corresponds to more than 50 percent of the edge having the cut-out.

In an exemplary embodiment, which may be combined with other embodiments disclosed herein, the distance between the metal plates is about 2 mm to about 4 mm, for example, 2.5 mm.

Figure 6:
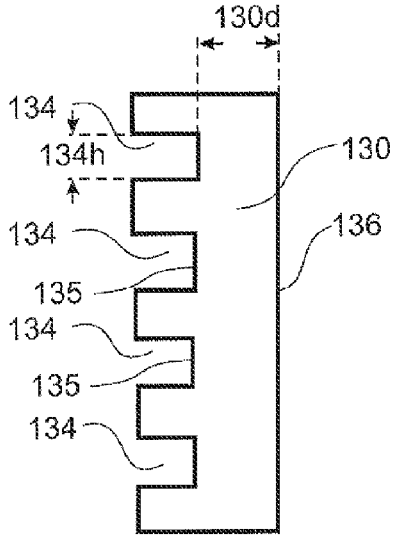
FIG. 6 shows schematically a side view of an exemplary support device.

FIG. 6 shows a schematical side view of an embodiment of a support device 130. The comb like support device 130 has a plurality of support cut outs 134, which can be regularly spaced. The support cut outs 134 can be provided on a side first to be introduced in the cut outs 132 of the metal plates 104, 108. In an exemplary embodiment, the support cut outs 134 may have height 134*h* corresponding to the thickness of the metal plates 104, 108. Thus, with a plurality of comb like support devices 130, a plurality of the metal plates 104, 108 may be grouped. The support device may be fabricated from a plastic material.

Further, in an embodiment, which may be combined with other embodiments disclosed herein, the remaining thickness 130*d* of the support device between a bottom 135 of the support cut outs 134 and a rearward edge 136 of the support device 130 opposite to the support cut outs 134 corresponds substantially to the depth 132 of the cut out in the metal plates. Thus, when the comb like support device 130 is inserted in the cut outs 132 of the metal plates, the rearward edge 136 opposite to the support cut outs 134 does not project from the circumference of the metal plates 104, 108. Hence, a sidewall of the housing may contact the metal plates of the arc chute.

For example, more than 70%, and for example, more than 90%, of a surface of a metal plate of a stack face the surface of an adjacent metal plate. Thus, the space between adjacent metal plates can be substantially free, for example, from a plastic frame or other material that may impede a creation of an arc between the respective adjacent metal plates. In an exemplary embodiment, which may be combined with other embodiments disclosed herein, more than 95% of the surface of a metal plate of the stack faces the surface of an adjacent metal plate. The arc between adjacent metal plates of a stack

102, 106 may not stay at the same place on the surface of a metal plate. For example, the arc may use the complete space to move around on the surface of the metal plate of an arc chute. Thus, the wear of the metal plates is more uniform, such that the distance and the thickness of the plates may be reduced. Further, also the cooling of the metal plates can be improved.

Figure 7:
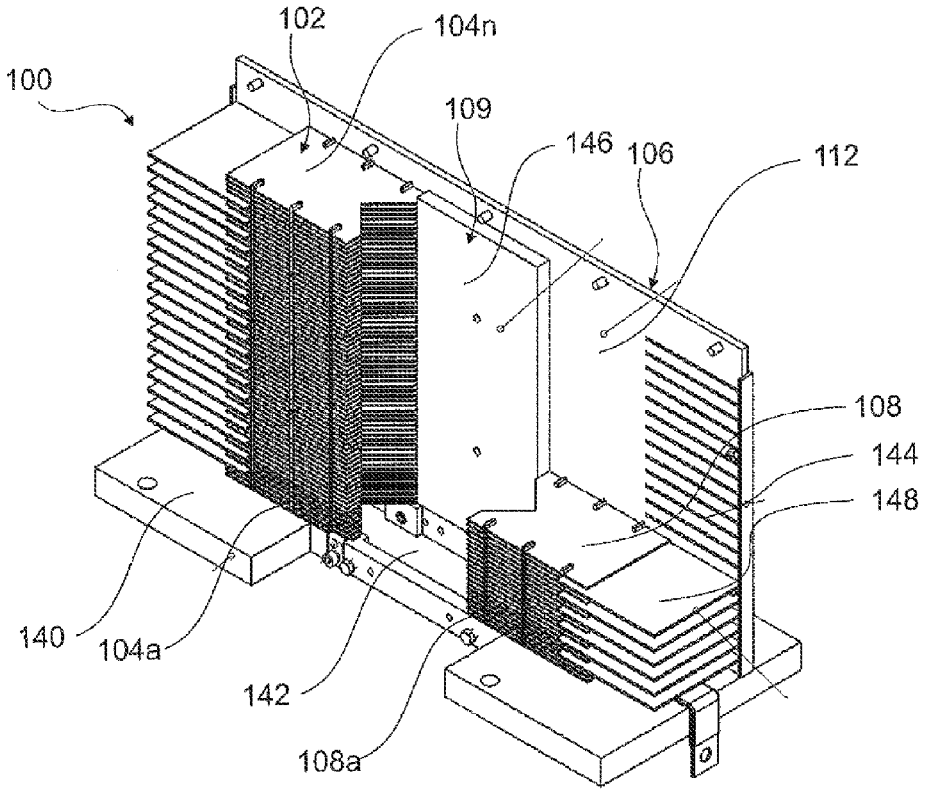
FIG. 7 shows schematically a perspective view of an arc chute according to an exemplary embodiment.
Figure 8:
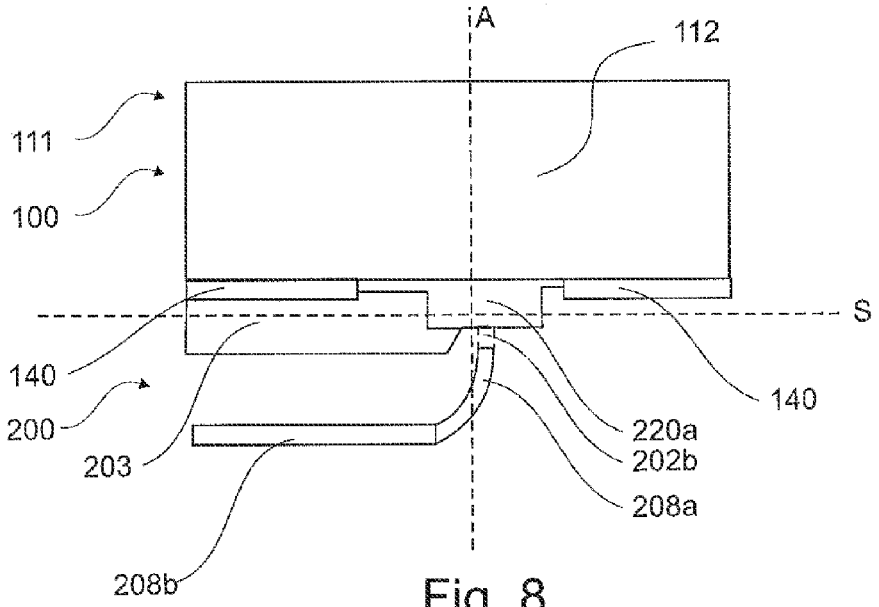
FIG. 8 shows schematically a side view of some elements of an exemplary embodiment of a circuit breaker.

FIG. 7 shows schematically a perspective view of an arc chute according to an embodiment and FIG. 8 shows schematically a side view of an embodiment circuit breaker. The arc chute 100 has an arc chute base 140, which is mounted on the switch unit 200. The base 140 has an opening 142 for the horns of the switch unit 200. Thus, the opening 142 can be disposed over the first switch contact 202*a* and a second switch contact 202*b*. The opening connects the arc chute 100, for example, the arc space 109 of the arc chute 100, with the switching space 226. An arc created between the first switch contact 202*a* and the second switch contact 202*b* enters the arc chute 100 through the opening 142. Further, the arc chute 100 includes a housing 111 having sidewalls 112. In an exemplary embodiment, the sidewalls 112 are manufactured from a plastic plate. For example, the sidewalls are substantially closed. The side wall 112 can be disposed in a plane parallel to a plane spanned by the moving direction S and the stacking direction A. In an embodiment, an internal stopper wall 146 is fixed to the sidewall 112 in the arc space 109, for example, to each sidewall 112, to limit the movement of the metal plates 104, 108 in the direction of the arc space 109 over the base opening 142, so that an arc can ascent within the arc chute 100 between the first stack 102 and the second stack 106. In a further embodiment, the stopper plate may be replaced by two parallel rails fixed to the side wall 112. In an exemplary embodiment, the blocks 128 of metal plates can be inserted from the top into the arc chute 100.

In an exemplary embodiment, which may be combined with other embodiments disclosed herein, the arc chute may include a plurality of substantially parallel deflectors 148 which are inserted in respective grooves 144 in the sidewalls 112. The grooves 144 can be substantially parallel to the plates 104*a*, 104*b*, . . . 104*n*, 108*a*, 108*b*, . . . 108*n*. The deflector plates 148 can guide the gas created in the arc chute in parallel to the metal plates out of the arc chute.

Figure 9:
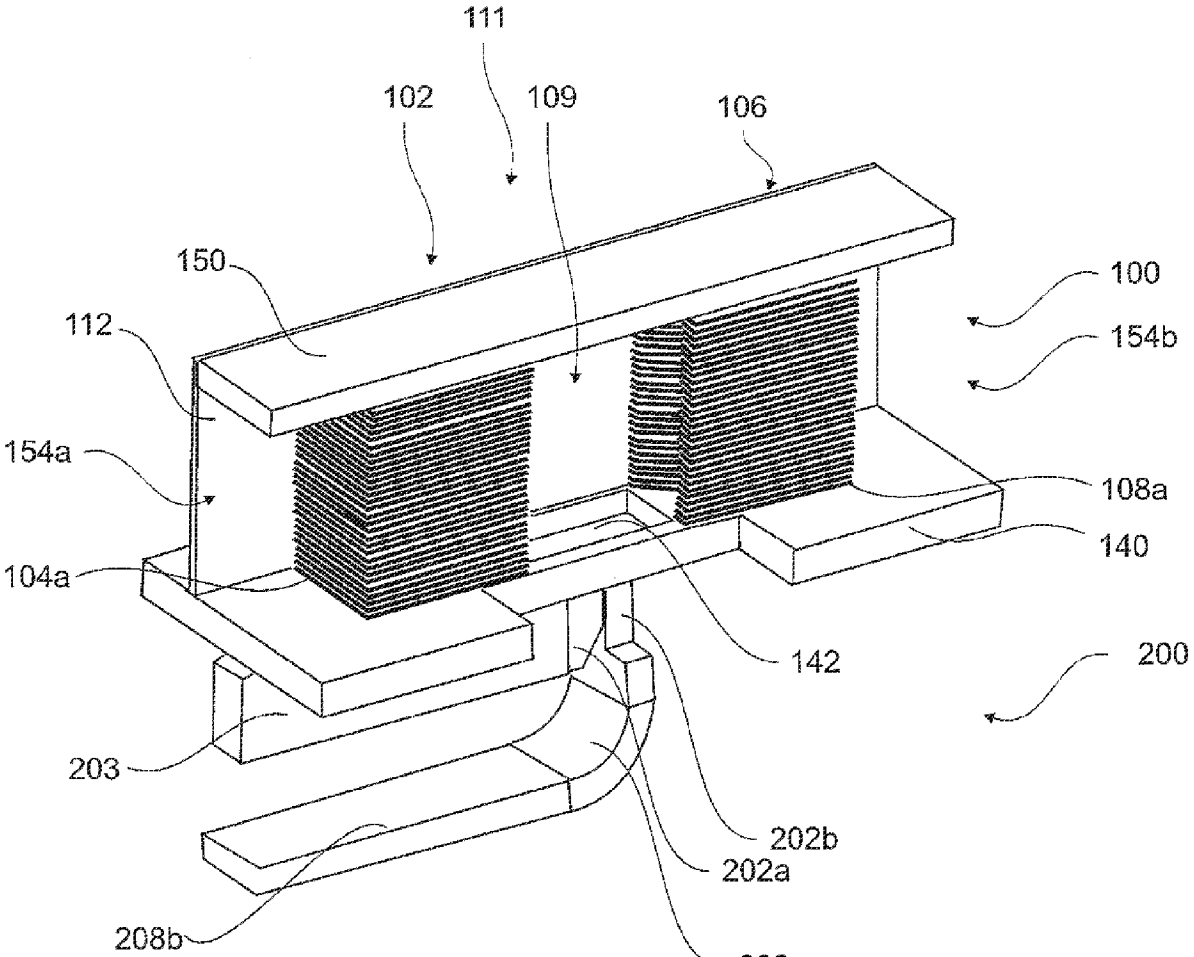
FIG. 9 shows schematically a side view of some elements of an exemplary embodiment of a circuit breaker.

The arc chute can be covered by a cover 150 shown in FIG. 9, which is fixed to the side walls 112. Hence, the number of pieces to assemble can be substantially reduced.

Thus, the arc chute 100 can be light and small due to the reduced clearance distance to a metallic wall of other components, for example, if the circuit breaker is mounted on an electric vehicle, for example, a train. Further, the metal plates of the arc chute can have almost no wear. Further, there is substantially no risk of short circuits between the metal plates. Thus, it is relatively easy to plan the maintenance of the circuit breaker, for example, of the arc chute. Further, the arc chute according to an embodiment can be assembled relatively quickly, and may be relatively easily scalable, for example, as no plastic mould is needed. Further, the costs can be reduced.

With the arc chute according to embodiments of the present disclosure the arc does not burn always at the same place, thus, the wear is more evenly distributed about the metal plates 104*a*, 104*b*, . . . 104*n*, 108*a*, 108*b*, . . . 108*n*, such that the distance of the plates may be reduced and also the thickness of the plates can be reduced.

Figure 10:
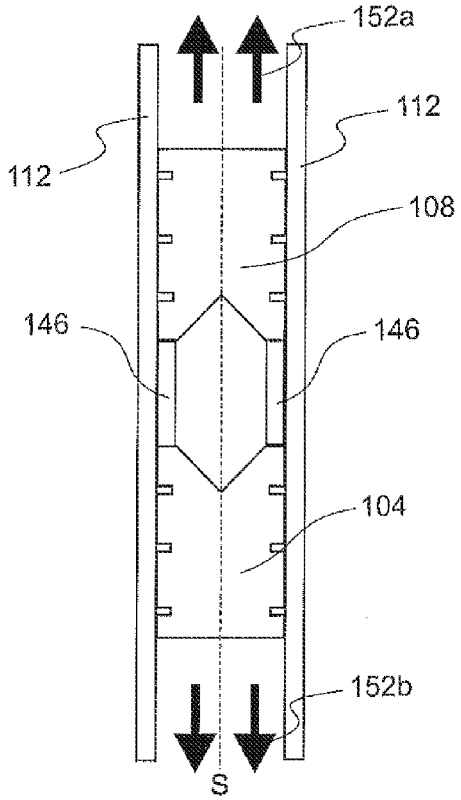
FIG. 10 shows schematically a section of an exemplary arc chute in a top view.

FIG. 10 shows a top view of a horizontal section of an embodiment of the arc chute 100. As shown in FIG. 10, the hot gases created during the disconnecting of the first switch contact and the second switch contact may substantially exhaust only in two directions 152*a*, 152*b*, for example, in parallel to the direction of the moving direction S of the second switch contact. The housing of the arc chute can have openings 154*a*, 154*b* in direction of the moving direction S or an axis traversing the two stacks of the arc chute and the arc space 109. In an exemplary embodiment, the openings 154*a*, 154*b* can have dimensions in the direction of the arc displacement direction A or stacking direction A of at least 90%, for example 95%, of the first stack 102 or the second stack of metal plates. Further, the openings 154*a*, 154*b* have a dimension orthogonal to the arc displacement direction A and the moving direction S corresponding substantially to the dimension of the metal plates, for example, at least 90%, for example, at least 95% of the width of the metal plates. The width of the metal plates can be measured along a third axis orthogonal to the arc displacement direction A and orthogonal to the moving direction S.

The sidewalls 112 of the housing can be in contact or adjacent to the metal plate of the first stack 102 and a second stack. For example, the distance between the sidewalls 112 of the housing and the metal plates is less than 5 mm, for example less than 2 mm. Hence, further equipment of the rolling stock on which such a circuit breaker may be disposed may be placed close to the circuit breaker, in contrast to circuit breakers in which the gas is exhausted to all sides of the metal plates 104, 108. Thus, the gas is only exhausted in a direction parallel to the moving direction S shown with arrows 152*a* and 152*b*.

Figure 11:
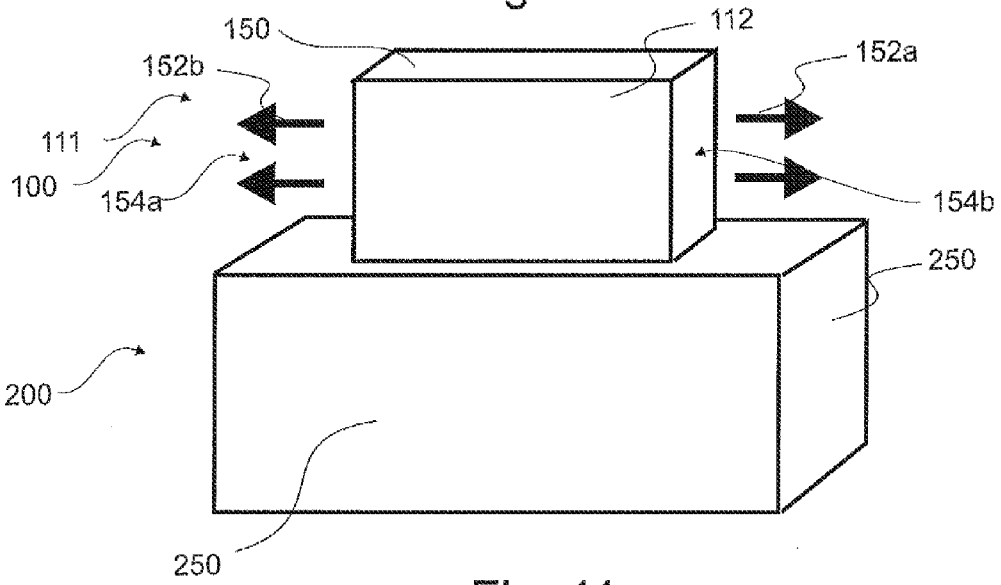
FIG. 11 shows schematically a perspective view of a circuit breaker according to an exemplary embodiment.

FIG. 11 shows a perspective view of an embodiment of a circuit breaker including the arc chute 100 and the switch unit 200. As shown in FIG. 10, the arc chute 100 is covered from the side with the sidewalls 112 and on the top with a cover plate 150.

Thus, in an exemplary embodiment, the arc chute can be easily assembled, because the sidewalls 112 and the cover plate 150 are plate shaped and fabricated of plastic. Hence, the arc chute is variable, so that he can be easily adapted to the current or the voltage to be switched, for example, the number of metal plates to be inserted into the arc chute can be easily adjusted by introducing more or less groups of metal plates 128. Further, the sidewalls 112 and the top wall 150 can be easily adapted because they are just plates which can be manufactured by sawing a bigger plate to the format used by the arc chute to be produced.

In an exemplary embodiment, which may be combined with other embodiments disclosed herein, the switch unit is covered by switch unit sidewalls 250, which are manufactured from plastic plates. Thus, also the switch unit 200 may be easily manufactured.

For example, for medium voltage DC circuit breakers the total arcing time is much longer than for AC (alternating current) circuit breakers. Thus, higher temperatures can be created and plasma may be generated between the first switch contact and the second switch contact and in the arc chute.

Thus, it will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

What is claimed is:

1. A medium voltage circuit breaker, the circuit breaker comprising:

a switch unit, comprising:

a first switch contact;

a second switch contact, which is movable between a first position, wherein the first switch contact contacts the second switch contact, and a second position, wherein the second switch contact is separated from the first switch contact;

a positioning element to position an arc chute on the switch unit, wherein the arc chute comprises a plurality of substantially parallel metal plates, the positioning element being arranged to guide an arc, which is created between the first switch contact and the second switch contact, into the arc chute in an arc displacement direction in order to be extinguished;

at least one gas emitting element comprising a gas emitting layer having a layer surface facing the first switch contact and the second switch contact, wherein the gas emitting element is arranged at a distance to the first switch contact and the second switch contact, and wherein upon an interruption operation of the circuit breaker at its nominal current, the arc between the first switch contact and the second switch contact will vaporize a portion of the gas emitting layer;

a first horn electrically connected to the first switch contact for guiding a first foot of the arc to a first stack of parallel metal plates of the arc chute; and a second horn electrically connected to the second switch contact for guiding a second foot of the arc to a second stack of parallel metal plates of the arc chute, wherein the layer surface of the at least one gas emitting element is parallel to at least a portion of the first horn and the second horn in a moveable direction of the second switch contact; and wherein more than 70% of a surface of a metal plate of the first stack of parallel metal plates and the second stack of parallel metal plates faces a surface of an adjacent metal plate;

an arc space disposed between the first stack and the second stack of parallel metal plates;

wherein the arc chute is symmetric to an axis traversing the arc space which is parallel to a stacking direction of the first stack of parallel metal plates and the second stack of parallel metal plates, and wherein the stacking direction of the first stack of parallel metal plates and the second stack of parallel metal plates is substantially parallel to the arc displacement direction, which is substantially orthogonal to a moving direction of the second switch contact.

2. The circuit breaker according to claim 1, wherein the metal plates of the arc chute have a surface of about 3000 $mm^2$ to about 12000 $mm^2$.

3. The circuit breaker according to claim 1, wherein interruption operations of the circuit breaker are performed at nominal currents with more than 5000 Ampere.

4. The circuit breaker according to claim 1, wherein the circuit breaker is an air circuit breaker.

5. The circuit breaker according to claim 1, wherein the circuit breaker is a traction vehicle DC circuit breaker.

6. The circuit breaker according to claim 5, wherein the traction vehicle DC circuit breaker is for a railway vehicle, a tramway, and/or a trolleybus.

7. The circuit breaker according to claim 1, wherein a portion of the first horn and/or the second horn disposed in parallel to the layer surface of the at least one gas emitting element is greater than 25% of the first and/or second horn, and greater than about 50% of an extension of the first and/or second horn in the moveable direction of the second switch contact.

8. The circuit breaker according to claim 1, wherein the layer surface is arranged parallel to a plane defined by the moveable direction of the second switch contact and the arc displacement direction.

9. The circuit breaker according to claim 1, wherein the gas emitting layer pushes the arc into the arc chute and/or increases the air resistance between the first switch contact and the second switch contact.

10. The circuit breaker according to claim 1, comprising:

at least two gas emitting elements having a layer surface facing the first switch contact and the second switch contact, wherein the layer surfaces of the at least two gas emitting elements and layer surfaces of the first switch contact and the second switch contact are facing each other.

11. The circuit breaker according to claim 10, wherein the layer surfaces of the at least two gas emitting elements and the first switch contact and the second switch contact are substantially parallel.

12. The circuit breaker according to claim 1, wherein a distance of the layer surfaces to the first switch contact and/or the second switch contact in the first position and the second position of the second switch contact is between about 15 mm and about 40 mm.

13. The circuit breaker according to claim 1, wherein the gas emitting layer is manufactured from a Fluoropolymer.

14. The circuit breaker according to claim 1, wherein the gas emitting layer has a thickness of about 2 mm to about 8 mm.

15. The circuit breaker according to claim 1, wherein the at least one gas emitting element extends in the direction of the arc chute substantially to a plane of a lowest metal plate of the first stack of the parallel metal plates and the second stack of parallel metal plates just below the lowest metal plate of the first stack.

16. The circuit breaker according to claim 1, wherein the at least one gas emitting element is plate shaped.

17. The circuit breaker according to claim 1, wherein the at least one gas emitting element is a T-shaped plate having a base portion and two arms.

18. The circuit breaker according to claim 17, comprising:

a switching space, in which the first switch contact and the second switch contact in the first position and in the second position are permanently disposed, and wherein a base portion of the at least one gas emitting element is disposed in the switching space, and the two arms extend in parallel to the first and/or second horn.

19. The circuit breaker according to claim 1, wherein the at least one gas emitting layer extends in the arc displacement direction substantially to a plane of a closest metal plate for splitting the arc in the arc chute.

* * * * *